US009162462B2

(12) United States Patent
Komatsu et al.

(10) Patent No.: US 9,162,462 B2
(45) Date of Patent: Oct. 20, 2015

(54) PRINTING APPARATUS AND CLEANING METHOD THEREOF

(71) Applicant: CANON KABUSHIKI KAISHA, Tokyo (JP)

(72) Inventors: Hiroaki Komatsu, Yokohama (JP); Masaya Uetsuki, Yokohama (JP); Kazuo Suzuki, Yokohama (JP); Toshimitsu Danzuka, Tokyo (JP); Masataka Kato, Yokohama (JP); Tsuyoshi Ibe, Yokohama (JP); Asako Tomida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/163,052

(22) Filed: Jan. 24, 2014

(65) Prior Publication Data

US 2014/0218440 A1 Aug. 7, 2014

(30) Foreign Application Priority Data

Feb. 1, 2013 (JP) ..... 2013-018957

(51) Int. Cl.
*B41J 2/165* (2006.01)

(52) U.S. Cl.
CPC ..... *B41J 2/16535* (2013.01); *B41J 2/16585* (2013.01)

(58) Field of Classification Search
USPC ..... 347/33
See application file for complete search history.

(56) References Cited

U.S. PATENT DOCUMENTS

| | | | | |
|---|---|---|---|---|
| 6,447,095 | B1 | 9/2002 | Kanda et al. | |
| 6,527,361 | B1 | 3/2003 | Gotoh et al. | |
| 6,557,969 | B1 | 5/2003 | Murakami et al. | |
| 6,644,777 | B2 | 11/2003 | Danzuka | |
| 6,702,421 | B2 | 3/2004 | Inui et al. | |
| 6,719,400 | B2 | 4/2004 | Inui et al. | |
| 6,752,485 | B2 | 6/2004 | Murakami et al. | |
| 6,854,826 | B2 | 2/2005 | Kanda et al. | |
| 6,984,018 | B2 | 1/2006 | Uetsuki et al. | |
| 7,287,825 | B2 | 10/2007 | Furuichi et al. | |
| 7,290,858 | B2 | 11/2007 | Furuichi et al. | |
| 7,527,348 | B2 | 5/2009 | Uetsuki et al. | |
| 2007/0091141 | A1* | 4/2007 | Jung et al. | 347/33 |
| 2008/0007606 | A1* | 1/2008 | Yanagimachi et al. | 347/100 |
| 2008/0266342 | A1* | 10/2008 | Steinfield et al. | 347/14 |
| 2012/0188304 | A1 | 7/2012 | Ibe et al. | |
| 2012/0218346 | A1* | 8/2012 | Inoue | 347/33 |
| 2013/0286078 | A1 | 10/2013 | Kato et al. | |

FOREIGN PATENT DOCUMENTS

| | | | |
|---|---|---|---|
| JP | 2005-021809 | A | 1/2005 |

* cited by examiner

*Primary Examiner* — Jason Uhlenhake
(74) *Attorney, Agent, or Firm* — Fitzpatrick, Cella, Harper & Scinto

(57) ABSTRACT

An embodiment of the present invention provides a wiping method capable of preventing a problem such as color mixing or a discharge failure in a wiping operation during the reciprocating motion of a carriage. According to the embodiment, one or a plurality of orifice arrays out of a plurality of orifice arrays included in a printhead are wiped by making a sheet-like wiping member contact to the orifice surface of the printhead. After that, the wiping member is separated from the orifice surface of the printhead, and the used wiping member is wound. Then, the wiping member is made to contact to the orifice surface of the printhead again, and the next one or more orifice arrays are wiped.

14 Claims, 10 Drawing Sheets

PRINTING APPARATUS AND CLEANING METHOD THEREOF

BACKGROUND OF THE INVENTION

1. Field of the Invention

The present invention relates to a printing apparatus and a cleaning method and, more particularly, to an inkjet printing apparatus and a cleaning method of wiping the orifice surface of an inkjet printhead mounted in the apparatus.

2. Description of the Related Art

Ink may stick to a surface (to be referred to as an orifice surface hereinafter) where orifices are formed in a printhead mounted in an inkjet printing apparatus (to be referred to as a printing apparatus hereinafter) and impede normal discharge. To prevent such a failure, the printing apparatus generally includes a wiping unit configured to wipe ink sticking to the orifice surface. To wipe the orifice surface, the wiping unit includes, for example, a wiping member made of an elastic material and a contact member used to make the wiping member contact the orifice surface. A wiping operation is performed by making the wiping member contact the orifice surface and slide at a predetermined timing.

In a so-called serial printing apparatus which performs printing by discharging ink to a printing medium while reciprocally moving a carriage with a printhead mounted on it, a method of wiping the orifice surface by moving the contact member during suspension of the reciprocating motion is known. There is also known a method of wiping the orifice surface by moving the printhead in a state in which the contact member is in contact. The latter wiping method is effective especially when the wiping frequency is high. That is, since the wiping operation can be performed during the reciprocating motion of the carriage, a single wiping operation can be done in a short time as compared to the method of performing the wiping operation during suspension of the reciprocating motion of the carriage.

Japanese Patent Laid-Open No. 2005-21809 discloses an example in which a sheet-like wiping member is made to slide in the vertical direction against the orifice array of the printhead, thereby performing wiping. The sheet-like wiping member is known to exert a greater wiping effect than a wiping method of causing a so-called wiper blade to slide.

As the inkjet printing apparatuses and printing methods thereof have diversified in recent years, printing using a plurality of color inks or inks reactive with each other may be done by a single or a plurality of printheads. In this case, if the wiping operation is performed by a single wiping member, an ink may mix in the orifices of another ink, and color mixing or an ink discharge failure due to solidification by reaction may occur.

In the method disclosed in Japanese Patent Laid-Open No. 2005-21809, the sheet-like wiping member is wound, thereby preventing an ink discharge failure due to color mixing and ink solidification by reaction from occurring. However, the effect is not sufficient.

SUMMARY OF THE INVENTION

Accordingly, the present invention is conceived as a response to the above-described disadvantages of the conventional art.

For example, a printing apparatus and a cleaning method thereof according to this invention are capable of preventing ink color mixing or a discharge failure from occurring in a wiping operation during the reciprocating motion of a carriage.

According to one aspect of the present invention, there is provided a printing apparatus. The apparatus comprises: a printhead formed by arranging a plurality of orifice arrays in a first direction perpendicular to a second direction, each of the orifice arrays including a plurality of orifices configured to discharge ink and arranged in the second direction; a carriage, on which the printhead is mounted, configured to move in the first direction; a wiper for wiping an orifice surface of the printhead using a windable sheet-like wiping member; a moving unit configured to move part of the sheet-like wiping member so that an area of the part of the sheet-like wiping member contacts to the orifice surface or retracts from the orifice surface; a winder for winding the sheet-like wiping member; and a control unit configured to control so that the moving unit moves the part of the sheet-like wiping member to make the area contact the orifice surface of the printhead, the moving unit moves the sheet-like wiping member toward the orifice surface according to movement of the carriage, and each orifice of at least one of the plurality of orifice arrays is wiped while the winder winds the sheet-like wiping member.

According to another aspect of the present invention, there is provided a cleaning method in a printing apparatus including a printhead formed by arranging a plurality of orifice arrays in a first direction perpendicular to a second direction, each of the orifice arrays including a plurality of orifices configured to discharge ink and arranged in the second direction, and a carriage, on which the printhead is mounted, configured to move in the first direction. The method comprises: moving an area of part of a windable sheet-like wiping member so that the area contacts to the orifice surface of the printhead; wiping orifices of at least one of the plurality of orifice arrays while moving the sheet-like wiping member toward the orifice surface as the carriage moves; and moving the part of the sheet-like wiping member so that the area of the part of the sheet-like wiping member used for the wiping is retracted from the orifice surface.

The invention is particularly advantageous since it is possible to prevent a problem such as color mixing or a discharge failure in the wiping operation during the reciprocating motion of the carriage. Additionally, in the wiping operation during the reciprocating motion of the carriage, one or a plurality of orifice arrays can selectively be wiped while suppressing the operation time of the wiping operation. This makes it possible to reduce ink solidification on the ink discharge surface of the printhead as well as color mixing and a discharge failure.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. The relative arrangement of constituent elements set forth in the embodiments do not limit the scope of the present invention unless it is specifically stated otherwise.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" generically means an ink orifice or a liquid channel communicating with it, and an element for generating energy used to discharge ink, unless otherwise specified.

Figure 1:
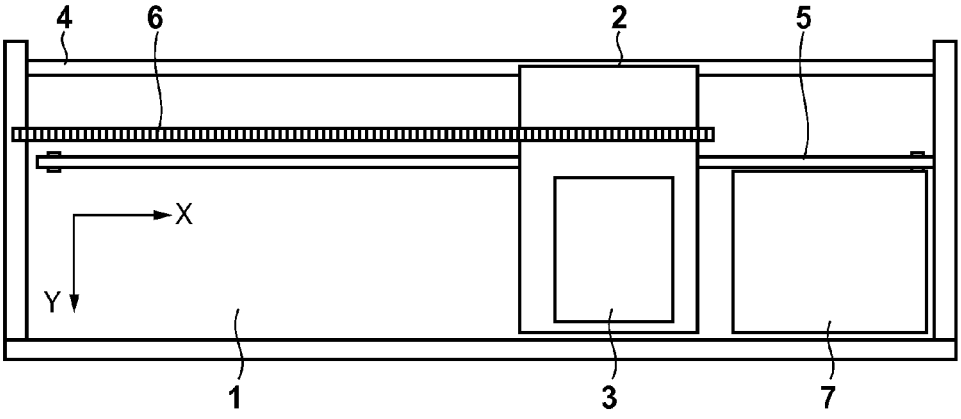
FIG. 1 is a plan view showing the schematic arrangement of an inkjet printing apparatus according to an exemplary embodiment.

FIG. 1 is a plan view showing the schematic arrangement of an inkjet printing apparatus (to be referred to as a printing apparatus hereinafter) according to an exemplary embodiment. In particular, FIG. 1 clearly illustrates the moving direction of a carriage 2 with an inkjet printhead (to be referred to as a printhead hereinafter) 3 mounted on it and the position relationship between the carriage 2 and a recovery unit configured to maintain satisfactory ink discharge performance of the printhead 3.

The printing apparatus 1 is a serial printing apparatus and performs printing while causing a conveyance unit (not shown) to intermittently convey a printing medium in the Y direction and moving the carriage 2 with the printhead 3 mounted on it in the X direction perpendicular to the Y direction that is the printing medium conveyance direction. The printing apparatus 1 has a large size in the X direction to enable printing on a relatively large printing medium (for example, A1 size).

The printhead 3 is detachably mounted on the carriage 2. The carriage 2 reciprocally moves along the X direction together with the printhead 3. More specifically, the carriage 2 is supported to be movable along a guide shaft 4 arranged along the X direction, and fixed to an endless belt 5 that moves approximately parallel to the guide shaft 4. The endless belt 5 reciprocally moves due to the driving force of a carriage motor (CR motor) so as to reciprocally move the carriage 2 in the X direction.

In addition, a scale 6 provided with slits at a predetermined interval is arranged along the moving direction (X direction) of the carriage 2. An encoder sensor (not shown) mounted on the carriage 2 reads the scale as the carriage 2 moves, thereby detecting the moving-direction position of the carriage 2.

Figure 2:
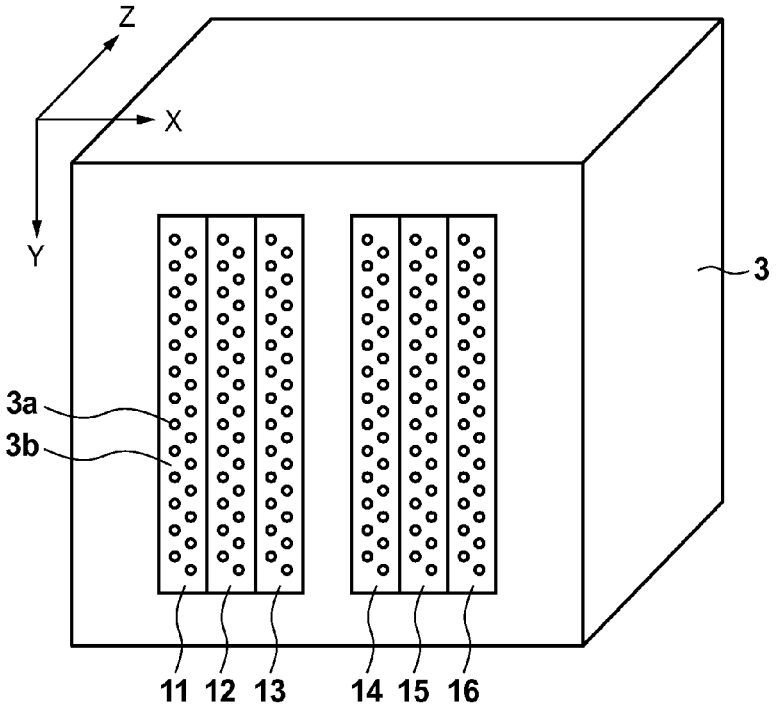
FIG. 2 is a schematic view particularly showing the orifice array structure of a printhead mounted on a carriage.

FIG. 2 is a schematic view particularly showing the orifice array structure of the printhead 3 mounted on the carriage 2. Note that the X and Y axes in FIG. 2 indicate the same directions as the X and Y axes in FIG. 1. FIG. 2 shows an example in which six orifice arrays 11 to 16 in each of which 1,280 orifices 3*a* for discharging ink of the same color are arrayed in the Y direction at a density of 1,200 dpi (dots/inch) are arranged in the X direction and formed in the printhead 3. However, the embodiment of the present invention is not limited to this. A printhead formed by arraying another number of orifices at another density and arranging another number of orifice arrays may be used.

The printhead 3 includes the plurality of orifices 3*a* formed in an orifice surface 3*b* shown in FIG. 2 along the Y direction, a plurality of fluid channels (not shown) formed in correspondence with the individual orifices 3*a*, and a common liquid chamber (not shown) that supplies ink to the plurality of fluid channels.

An energy generation element that generates discharge energy used to cause the orifice 3*a* to discharge ink is arranged in each fluid channel of the printhead 3. In this embodiment, an electrothermal transducer that locally heatsink to cause film boiling and causes the orifice to discharge the ink by the pressure is used. However, the present invention is not limited to this, and an electromechanical transducer such as a piezoelectric element may be used. Note that in the following description, each orifice 3*a* and a corresponding fluid channel will inclusively be referred to as a nozzle.

In the printhead 3, inks containing different color materials, for example, cyan, light cyan, magenta, light magenta, yellow, and black inks are supplied from ink tanks (not shown) storing the inks in correspondence with the above-described six orifice arrays. Each ink tank provided in the printing apparatus main body is connected, via a tube (not shown), to the ink supply port of a corresponding one of the orifice arrays 11 to 16 and supplies the ink. Note that these inks can arbitrarily be set, and the types and colors of the inks to be mounted are merely examples.

Figure 3:
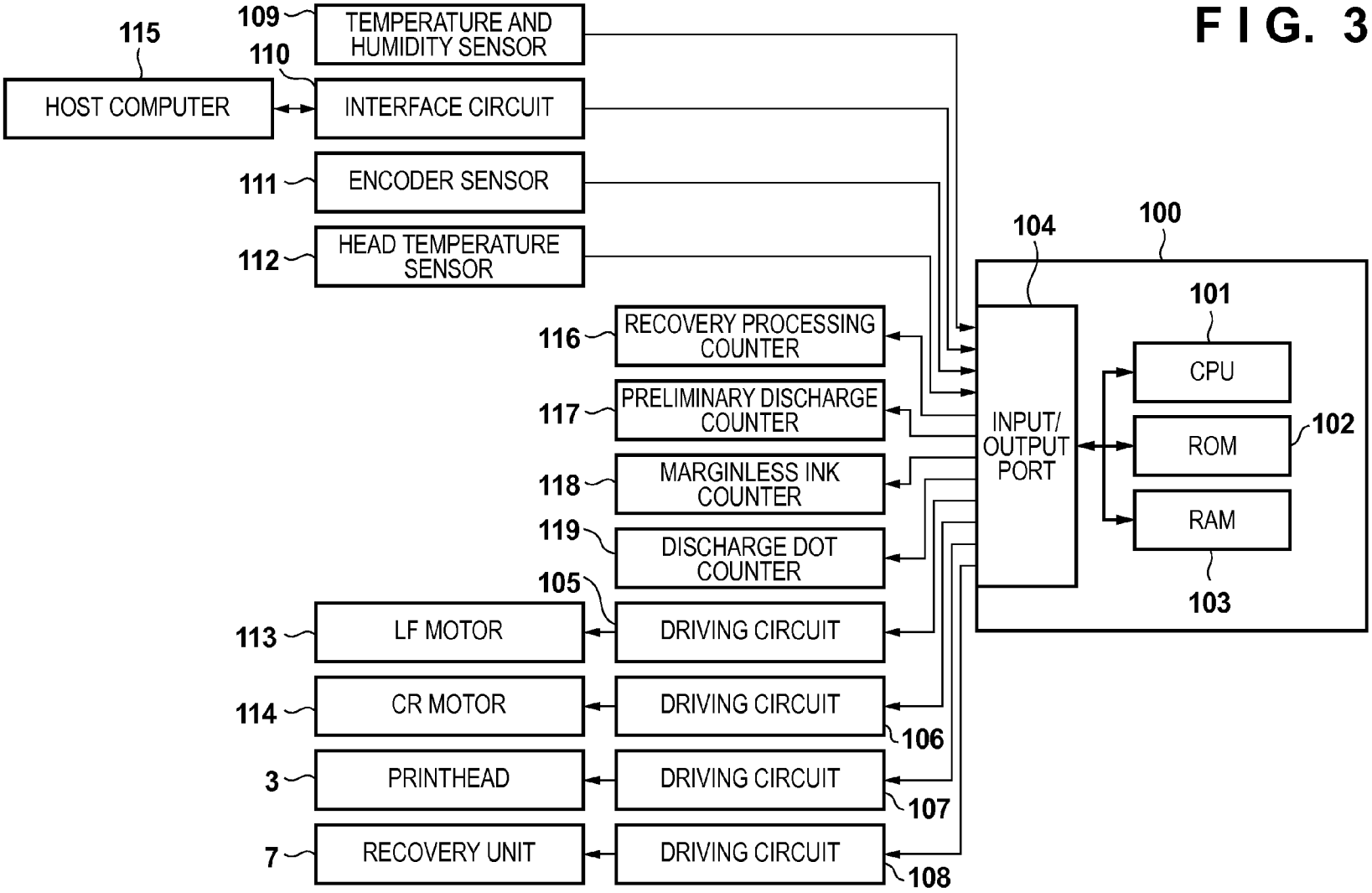
FIG. 3 is a block diagram showing the control arrangement of the printing apparatus shown in FIG. 1.

FIG. 3 is a block diagram showing the control arrangement of the printing apparatus 1 shown in FIG. 1.

As shown in FIG. 3, a main control unit 100 includes a CPU 101 that executes processes such as calculation, control, determination, and setting, and a ROM 102 that stores control programs to be executed by the CPU 101 and the like. The main control unit 100 also includes a RAM 103 used as a buffer that stores binary print data representing ink discharge/non-discharge and a work area for the processes of the CPU 101, and an input/output port 104.

Driving circuits 105, 106, 107, and 108 of a conveyance motor (LF motor) 113 of a conveyance mechanism, a carriage motor (CR motor) 114, the printhead 3, and a recovery unit 7 are connected to the input/output port 104. Sensors such as a head temperature sensor 112 that detects the temperature of the printhead 3, an encoder sensor 111 fixed to the carriage 2, and a temperature and humidity sensor 109 that senses the temperature and humidity as the use environment of the printing apparatus 1 are also connected to the input/output port 104. The main control unit 100 is connected to a host computer (to be referred to as a host hereinafter) 115 via an interface circuit 110.

When the recovery unit 7 forces the printhead 3 to discharge ink, a recovery processing counter 116 counts the amount of ink. A preliminary discharge counter 117 counts the amount of ink of preliminary discharge performed before, after, or during printing. A marginless ink counter 118 counts the amount of ink printed outside the printing medium area when performing marginless printing. A discharge dot counter 119 counts the amount of ink discharged during printing.

The outline of a printing operation executed by the printing apparatus having the above-described arrangement is as follows. That is, when print data is received from the host 115 via the interface circuit 110, the print data is rendered on the buffer of the RAM 103. When the printing operation is instructed, the conveyance mechanism (not shown) operates and conveys a printing medium to a position facing the printhead 3. At this time, the carriage 2 moves in the X direction along the guide shaft 4. As the carriage 2 moves, the printhead 3 discharges ink droplets, and an image corresponding to one carriage scan is printed on the printing medium. After that, the conveyance unit conveys the printing medium in the Y direction perpendicular to the carriage 2 by one scan printing. The above-described operation is repeated, thereby forming a predetermined image on the printing medium.

Note that the position of the carriage 2 is detected by causing the main control unit 100 to count pulse signals output from the encoder sensor 111 in accordance with the movement of the carriage 2. That is, the encoder sensor 111 detects the slits formed at a predetermined interval in the scale 6 (see FIG. 1) arranged along the X direction, thereby outputting the pulse signals to the main control unit 100. The main control unit 100 counts the pulse signals and thus detects the position of the carriage 2. The movement of the carriage 2 to the home position and other positions is done based on the signal from the encoder sensor 111.

Several embodiments will be described next concerning a cleaning operation of the printhead and, more particularly, a wiping operation of the orifice surface of the printhead executed by the printing apparatus having the above-described arrangement.

First Embodiment

Figure 4:
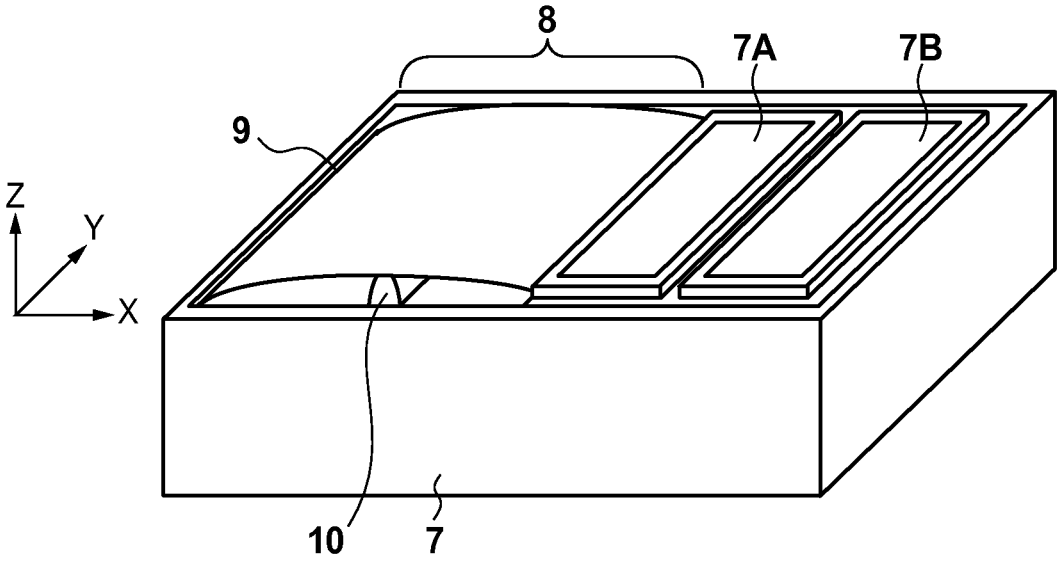
FIG. 4 is a perspective view showing the detailed arrangement of a recovery unit that executes a recovery operation to maintain satisfactory ink discharge performance from each orifice of the printhead.

FIG. 4 is a perspective view showing the detailed arrangement of a recovery unit 7 that executes a recovery operation to maintain satisfactory ink discharge performance from each orifice 3*a* of a printhead 3. The recovery unit 7 is held and fixed at a predetermined position of a printing apparatus 1 and, more specifically, at one end of the reciprocating motion of the carriage, as illustrated in FIG. 1 as well.

The recovery unit 7 includes suction recovery mechanisms 7A and 7B, an elevating mechanism (not shown) that moves the suction recovery mechanisms up and down, and a wiping unit 8. The suction recovery mechanisms 7A and 7B perform suction recovery processing that is one form of recovery processing. The suction recovery processing is processing of forcibly sucking ink from a plurality of nozzles formed in the printhead so as to replace the ink in the nozzles with ink suitable for discharge. More specifically, each of the suction recovery mechanisms 7A and 7B covers an orifice surface 3*b* with a cap, generates a negative pressure in the cap by a pump (not shown) communicating with the cap, and forcibly sucks ink from the orifices 3*a* by the negative pressure. Note that the suction recovery mechanisms 7A and 7B perform the suction recovery processing for three orifice arrays 11 to 13 and three orifice arrays 14 to 16, respectively.

The wiping unit 8 is provided at a position where it can face the reciprocating motion turning position of the printhead 3 (for example, the home position of the printhead) in the vertical direction (Z direction). The wiping unit 8 includes a wiping member 9 made of sheet-like material, a contact member 10 used to make the wiping member 9 contact the orifice surface 3*b*, and a contact member holding unit (not shown) that is movable between the contact position of the contact member 10 and the retracted position where the contact member 10 is not in contact. The moving direction is the Z direction, that is, the direction perpendicular to the orifice surface.

Figure 5A:
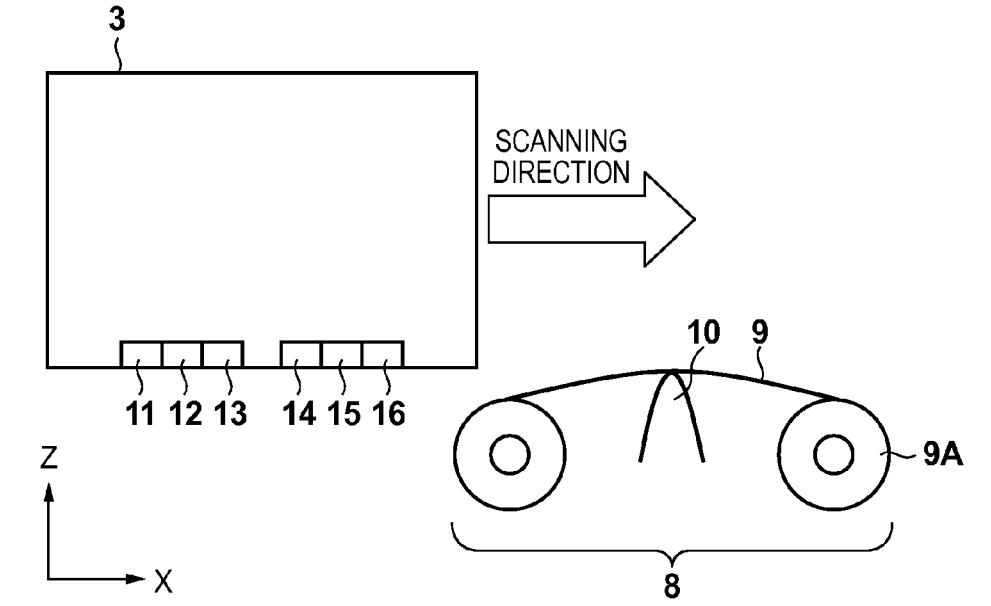
FIGS. 5A and 5B are side views showing a state of a wiping operation of the printhead by a wiping unit.
Figure 5B:
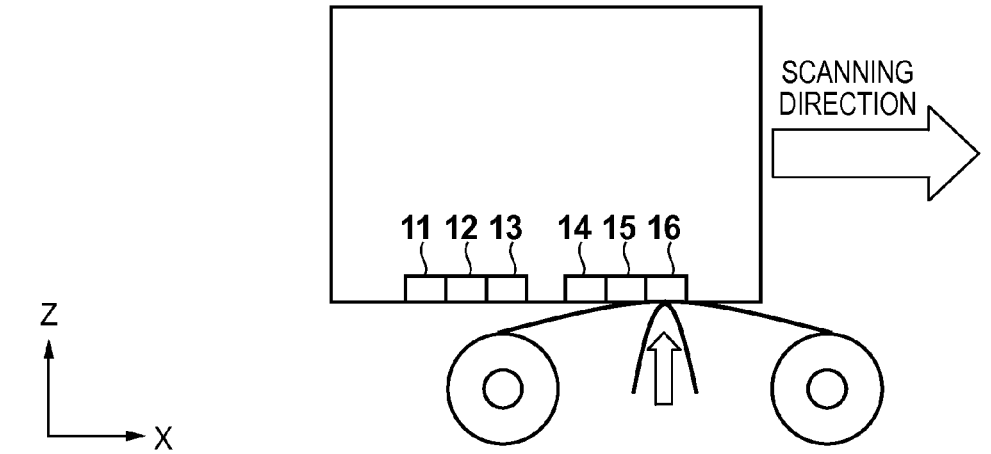

FIGS. 5A and 5B are side views showing a state of a wiping operation of the printhead 3 by the wiping unit 8.

Note that referring to FIGS. 5A and 5B, a winding unit 9A winds the wiping member 9 made of a sheet-like material. The winding unit 9A is operable independently of the vertical position (Z-direction position) of the contact member 10. The winding direction is parallel to the X direction, that is, a carriage movement direction. As described above, the contact member 10 is held by the contact member holding unit (not shown) movable between the contact position and the retracted position where the contact member is not in contact.

FIG. 5A shows a state in which the printhead 3 moves to the contact position. The movement of the printhead 3 is synonymous with the movement of the carriage. This movement will be referred to as the movement of the printhead hereinafter because the description will be made while focusing the printhead. FIG. 5B shows a state in which the orifice surface of the orifice array 16 of the printhead 3 is wiped. As shown in FIGS. 5A and 5B, in a state in which the contact member 10 is pushed up to the contact position by the contact member holding unit (not shown), the printhead 3 is moved in the scanning direction, and the wiping member 9 is pressed against the orifice surface and made to slide, thereby executing a single wiping operation.

FIGS. 6A to 6E are views showing an example of a wiping operation of selectively wiping the orifice arrays 16, 15, and 14 by the wiping unit 8.

Figure 6A:
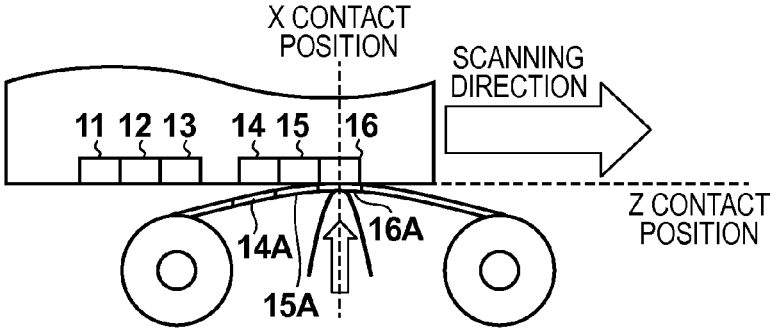
FIGS. 6A, 6B, 6C, 6D, and 6E are views showing an example of a wiping operation of selectively wiping three orifice arrays by the wiping unit.
Figure 6B:
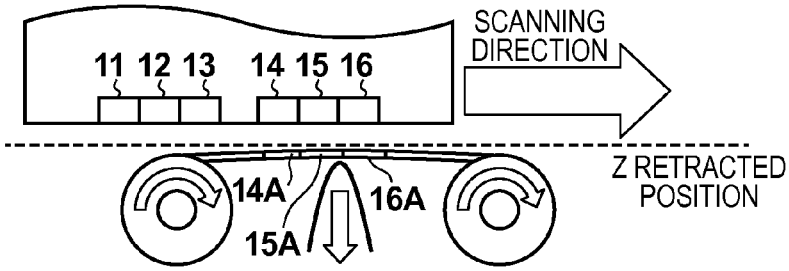
Figure 6C:
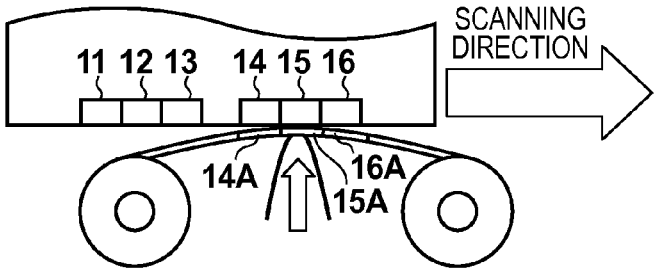
Figure 6D:
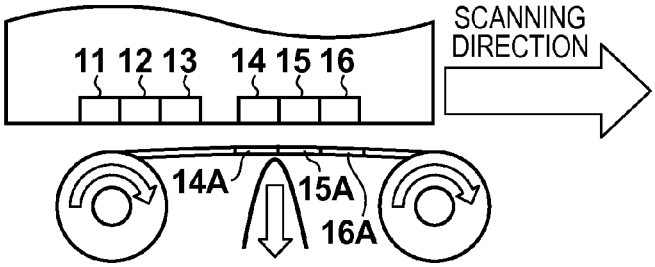
Figure 6E:
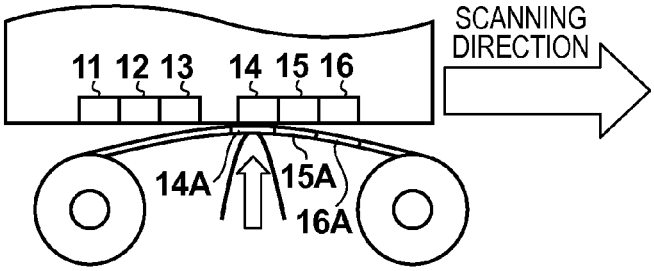

Referring to these drawings, the time elapses, and the printhead 3 moves in the order of FIG. 6A→FIG. 6B→FIG. 6C→FIG. 6D→FIG. 6E. An X contact position indicated by a broken line in FIG. 6A is the X-direction position, that is, the X-direction contact position of the contact member 10. A Z contact position indicated by another broken line is the Z-direction position, that is, the Z-direction contact position of the orifice array. A Z retracted position indicated by the broken line in FIG. 6B is the Z-direction retracted position at which the contact member 10 does not contact the orifice surface of the printhead 3. Referring to FIGS. 6A to 6E, reference numerals 16A, 15A, and 14A denote parts of the wiping member 9 that wipes the orifice arrays 16, 15, and 14 and represent areas of the contact surface with respect to the orifice arrays. Note that the remaining names in the drawings are the same as those described with reference to the drawings up to FIGS. 5A and 5B, and a description thereof will be omitted.

First, as shown in FIG. 6A, the contact member 10 is pushed up to the Z contact position before the first wiping target orifice array (orifice array 16 in FIG. 6A) moves to the X contact position. After that, the first wiping target orifice array moves to the X contact position and contacts the area 16A on the wiping member, thereby executing a single wiping operation.

Next, as shown in FIG. 6B, after completion of wiping of the first wiping target orifice array, the contact member 10 is lowered to the Z retracted position. At the same time, the winding unit 9A winds the wiping member 9 by an amount corresponding to the area used to wipe the orifice array 16 in a direction in which the contact surface of the wiping member 9 travels along the moving direction of the printhead 3. The winding direction is clockwise in FIGS. 6A to 6E. When wiping the next wiping target orifice array 15, the new contact surface on the wiping member, that is, the area 15A is used.

Then, as shown in FIG. 6C, the contact member 10 is pushed up to the Z contact position before the second wiping target orifice array (orifice array 15 in FIG. 6C) moves to the X contact position. After that, the second wiping target orifice array moves to the X contact position, and the next single wiping operation is executed. The same operation as described above is executed for the third wiping target orifice array 14 as well, as shown in FIGS. 6D and 6E.

When the above-described operation is performed, the contact surface of the wiping member 9 can be changed between when wiping the orifice array 16, when wiping the orifice array 15, and when wiping the orifice array 14. This enables selective wiping.

Note that although selective wiping of the three orifice arrays on the downstream side in the moving direction of the printhead 3 has been described above, the combination of the selective wiping target orifice arrays is not limited to this.

In the above-described example, the orifice arrays are selectively wiped in the direction in which the printhead 3 moves toward the X contact position. However, the wiping operation may be done when the printhead moves away from the X contact position. For example, the wiping operation may be performed for the orifice arrays 13, 12, and 11 in this order concerning the scanning direction of the printhead shown in FIGS. 6A to 6E.

Second Embodiment

An example in which a certain orifice array and an orifice array group including a plurality of orifice arrays are selectively wiped will be described.

FIGS. 7A to 7E are views for explaining wiping operation control according to the second embodiment. FIGS. 7A to 7E show a state of a wiping operation of selectively wiping an orifice array 16 and an orifice array group including orifice arrays 15 and 14 by a wiping unit 8.

Figure 7A:
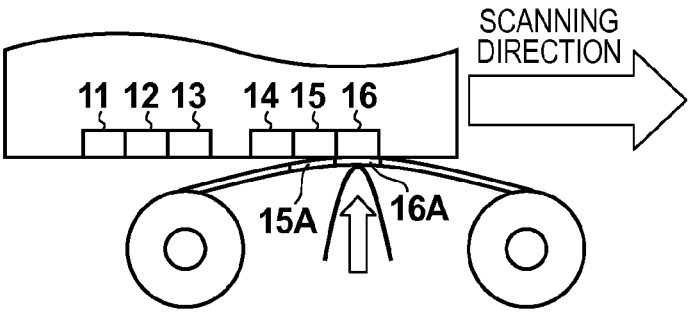
FIGS. 7A, 7B, 7C, 7D, and 7E are views for explaining wiping operation control according to the second embodiment.
Figure 7B:
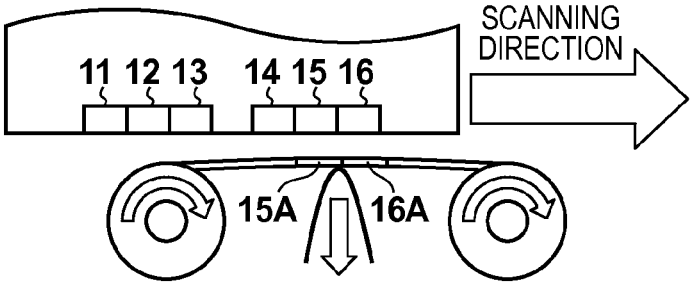
Figure 7C:
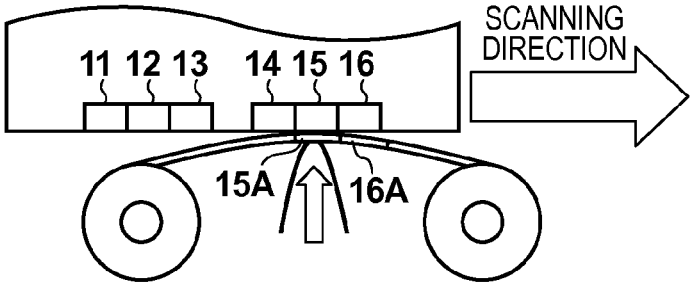
Figure 7D:
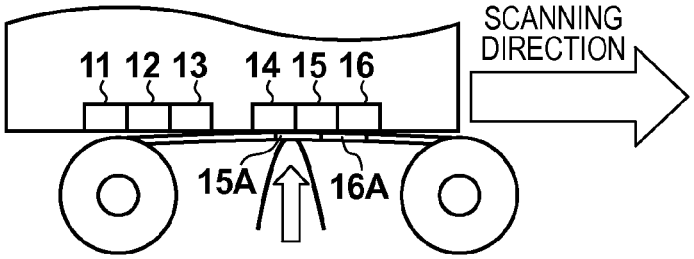
Figure 7E:
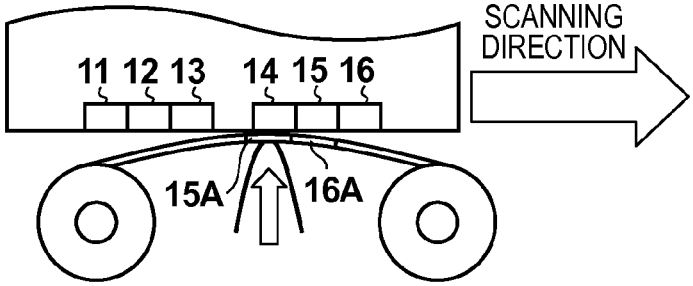

Referring to these drawings, the time elapses, and a printhead 3 moves in the order of FIG. 7A→FIG. 7B→FIG. 7C→FIG. 7D→FIG. 7E. Note that the rest of the arrangement is the same as in FIGS. 6A to 6E, and a description thereof will be omitted.

First, as shown in FIG. 7A, a contact member 10 is pushed up to the Z contact position before the first wiping target orifice array (orifice array 16 in FIG. 7A) moves to the X contact position. After that, the first wiping target orifice array moves to the X contact position and contacts an area 16A on the wiping member, thereby executing a single wiping operation.

Next, as shown in FIG. 7B, after completion of wiping of the first wiping target orifice array, the contact member 10 is lowered to the Z retracted position. At the same time, a winding unit 9A winds a wiping member 9 by an amount corresponding to the area used to wipe the orifice array 16 in a direction in which the contact surface of the wiping member 9 travels along the moving direction of the printhead 3. The winding direction is clockwise in FIGS. 7A to 7E. When wiping the next wiping target orifice array 15, the new contact surface on the wiping member, that is, an area 15A is used.

Then, as shown in FIG. 7C, the contact member 10 is pushed up to the Z contact position before the second wiping target orifice array (orifice array 15 in FIG. 7C) moves to the X contact position. After that, the second wiping target orifice array moves to the X contact position, and the next wiping operation is executed. After that, as shown in FIG. 7D, the contact member 10 is maintained at the Z contact position, unlike the first embodiment. As shown in FIG. 7E, the wiping operation of the third wiping target orifice array 14 is executed without winding the wiping member.

When the above-described operation is performed, the contact surface of the wiping member 9 can be changed between when wiping the orifice array 16 and when wiping the orifice arrays 15 and 14. This enables selective wiping.

In this embodiment, the same contact surface on the wiping member is used for the orifice arrays 15 and 14, unlike the first embodiment. This is effective in a case where, for example, the orifice array 16 discharges cyan ink, the orifice array 15 discharges magenta ink, and the orifice array 14 discharges black ink. That is, if the orifice arrays 16 and 15 are wiped by the same contact surface, color mixing may be conspicuous. However, if the orifice arrays 15 and 14 are wiped in this order, and the orifice array 14 discharges black ink, color mixing is inconspicuous, and selective wiping is unnecessary. At this time, in a case where wiping is performed in the order of orifice array 15→orifice array 14, wiping can be executed by a single wiping operation without winding the wiping member. It is therefore possible to save the use amount of the wiping member.

Note that although selective wiping of the orifice array 16 and the orifice array group including the orifice arrays 15 and 14 has been described above, the combination of the selective wiping target orifice arrays is not limited to this. In this example, the orifice arrays are selectively wiped in the direction in which the printhead 3 moves toward the X contact position. However, the wiping operation may be done when the printhead 3 moves away from the X contact position, as described in the first embodiment.

Third Embodiment

In this embodiment, a description will be made assuming that two printheads 3 are mounted on a carriage 2 in FIG. 1.

Hence, inks containing various color materials can be used in correspondence with 12 orifice arrays included in the two printheads 3. For example, cyan, light cyan, magenta, light magenta, yellow, black, red, green, blue, orange, gray, and light gray inks are supplied from ink tanks (not shown) storing the inks.

Note that in this embodiment, a case where the two printheads 3 are mounted has been described. However, the present invention is not limited to this, and a plurality of printheads such as three or four printheads may be mounted.

Figure 8:
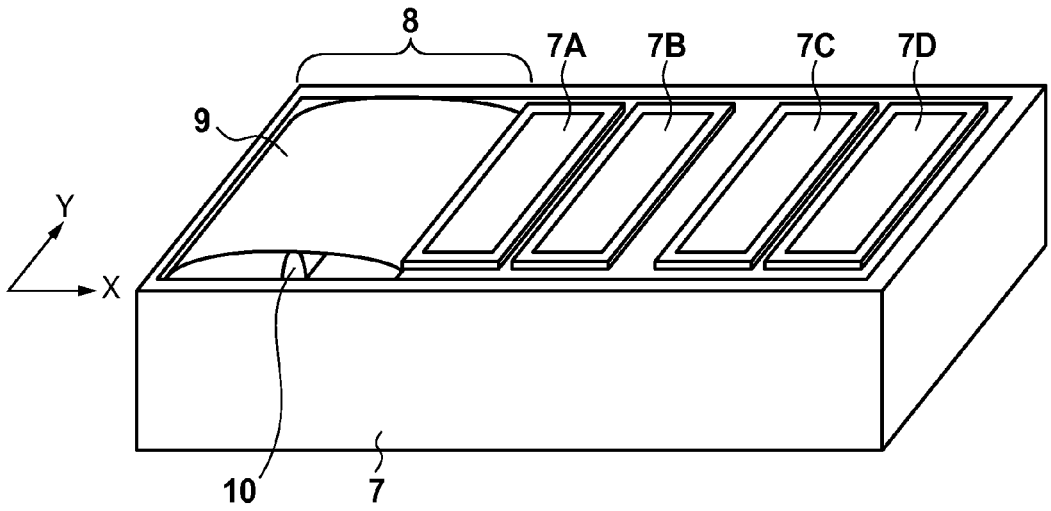
FIG. 8 is a perspective view showing the detailed arrangement of a recovery unit according to the third embodiment.

FIG. 8 is a perspective view showing the detailed arrangement of a recovery unit 7 according to the third embodiment. Note that a description of the same arrangement and same constituent elements as in the recovery unit described in the first embodiment will be omitted, and only an arrangement and constituent elements unique to the third embodiment will be described here.

In correspondence with the two printheads 3 mounted on the carriage 2, the recovery unit 7 according to this embodiment includes two additional suction recovery mechanisms 7C and 7D in addition to suction recovery mechanisms 7A and 7B. Hence, the elevating mechanism (not shown) that moves the suction recovery mechanisms up and down also copes with the up/down movement of the four suction recovery mechanisms.

Note that the suction recovery mechanisms 7A and 7B perform the suction recovery processing for three orifice arrays 11 to 13 and three orifice arrays 14 to 16 of one of the two printheads, respectively. The suction recovery mechanisms 7C and 7D perform the suction recovery for the three orifice arrays 11 to 13 and the three orifice arrays 14 to 16 of the other printhead, respectively.

Note that although FIG. 8 shows an example in which the four suction recovery mechanisms 7A, 7B, 7C, and 7D are provided in correspondence with the two printheads 3, the present invention is not limited to this. For example, only the two suction recovery mechanisms 7A and 7B may be provided. After the two suction recovery mechanisms 7A and 7B execute the suction recovery processing of one printhead, the carriage 2 may be moved, and the same suction recovery mechanisms 7A and 7B may execute the suction recovery processing of the other printhead.

Figure 9A:
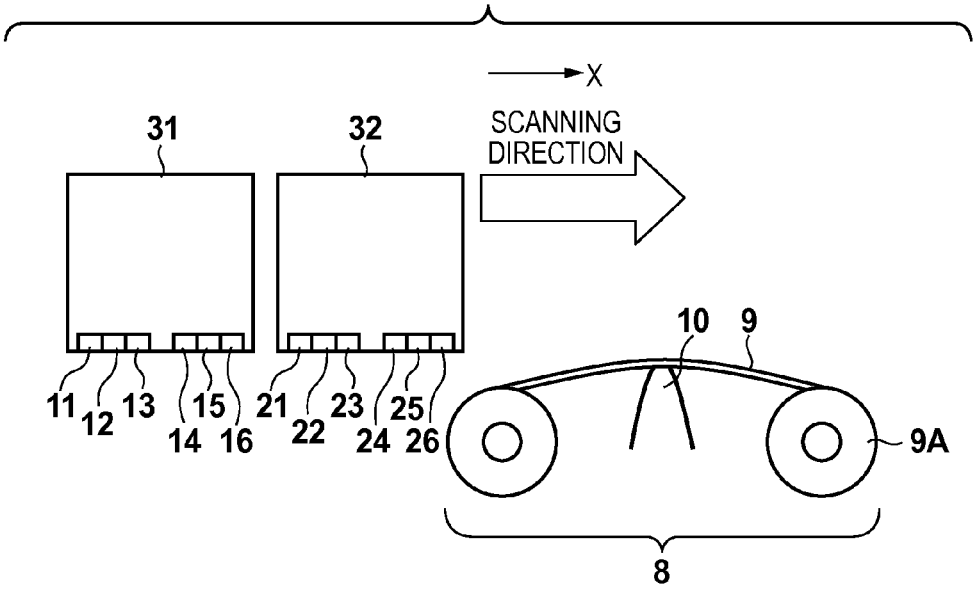
FIGS. 9A and 9B are side views showing a state of a wiping operation of two printheads by a wiping unit.
Figure 9B:
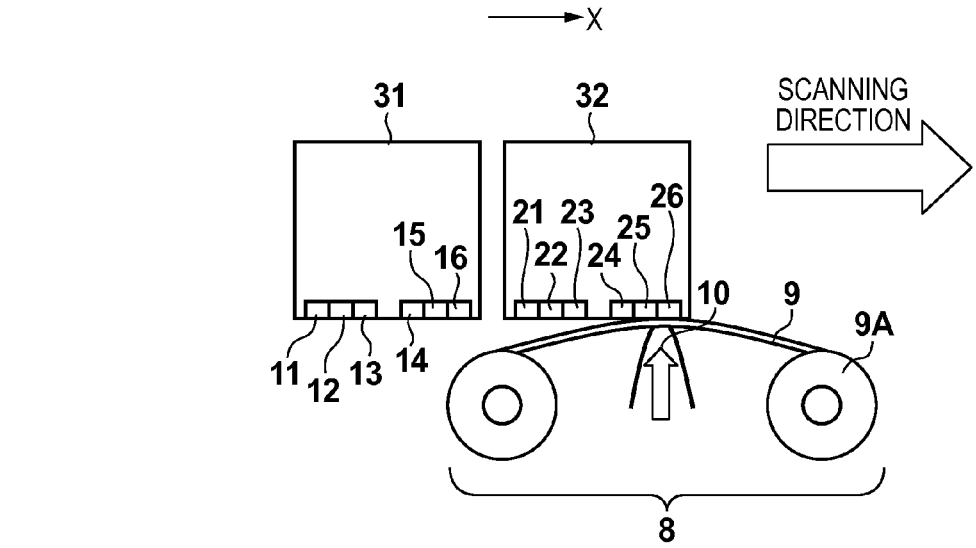

FIGS. 9A and 9B are side views showing a state of a wiping operation of the two printheads by a wiping unit 8. Note that the winding unit of the wiping member has the same arrangement as described in the first embodiment and therefore has the same reference numeral, and a description thereof will be omitted. The winding unit is a device configured to wind a wiping member 9 made of sheet-like material. In FIGS. 9A and 9B, one of the two printheads will be referred to as a printhead 31, and the other as a printhead 32 for the sake of discrimination. Although the two printheads are the same as the printhead 3 described with reference to FIG. 2, the colors and types of inks to be supplied by them may be different.

As is apparent from FIGS. 9A and 9B, the printhead 31 is arranged on the upstream side, and the printhead 32 on the downstream side with respect to their scanning direction. The six orifice arrays of the printhead 31 are defined as the orifice arrays 11, 12, 13, 14, 15, and 16 from the upstream side, and the six orifice arrays of the printhead 32 are defined as orifice arrays 21, 22, 23, 24, 25, and 26 from the upstream side.

FIG. 9A shows a state in which the printheads 31 and 32 mounted on the carriage 2 move to the contact position, and FIG. 9B shows a state in which the orifices of the orifice array 26 of the printhead 32 is wiped. As shown in FIG. 9B, in a state in which a contact member 10 is pushed up to the contact position by a contact member holding unit (not shown), the printheads 31 and 32 are moved in the scanning direction, and the contact member 10 is pressed against the orifice surface and made to slide, thereby executing a wiping operation.

Figures 10A, 10B, 10C:
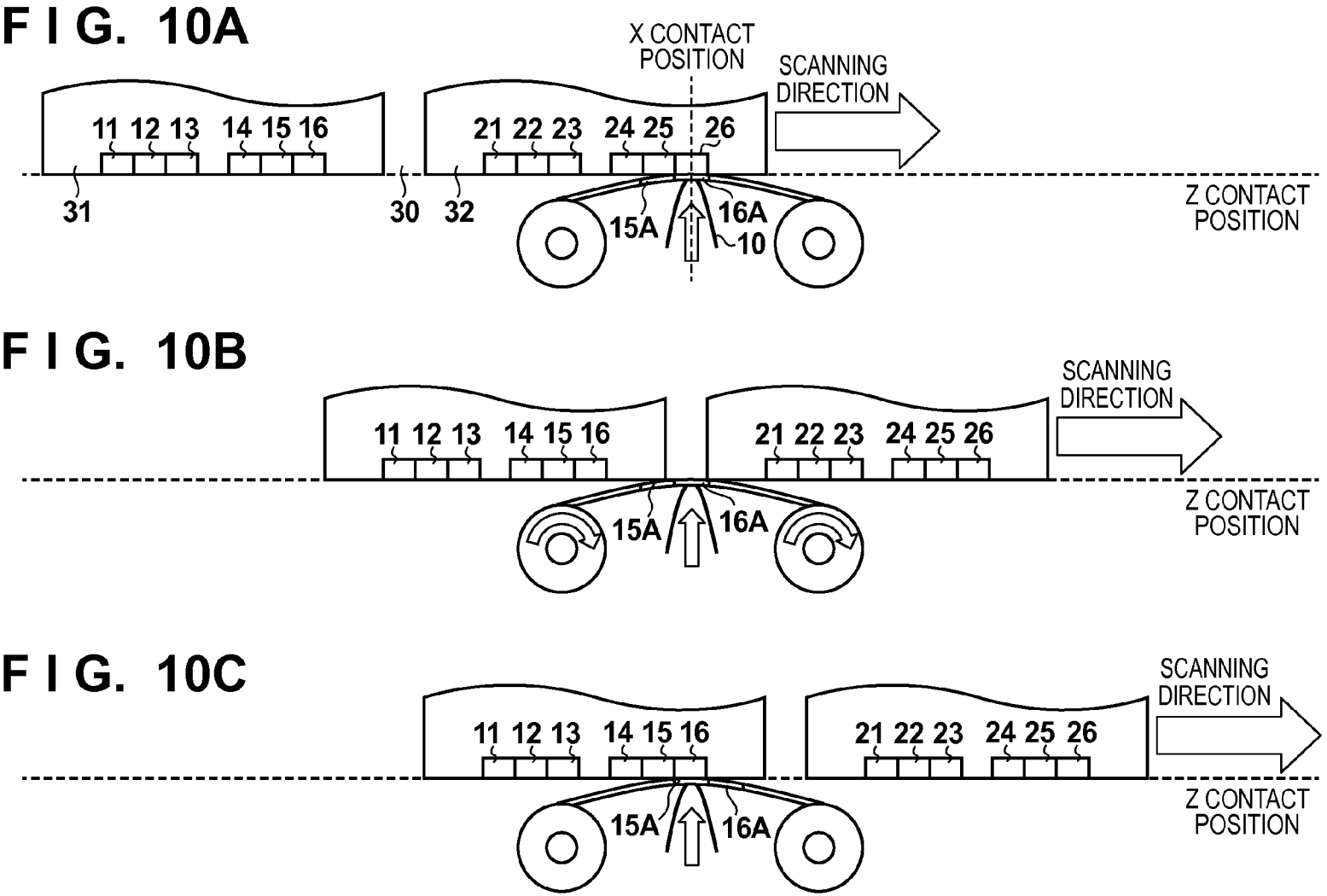
FIGS. 10A, 10B, and 10C are views showing an example of a wiping operation of selectively wiping six orifice arrays of one printhead and six orifice arrays of another printhead by a wiping unit.

FIGS. 10A to 10C are views showing an example of a wiping operation of selectively wiping the orifice arrays 11 to 16 of the printhead 31 and the orifice arrays 21 to 26 of the printhead 32 by the wiping unit 8. Referring to these drawings, the time elapses, and the printheads 31 and 32 move in the scanning direction in the order of FIG. 10A→FIG. 10B→FIG. 10C.

An X contact position indicated by a broken line in FIG. 10A is the X-direction position of the contact member 10, that is, the X-direction contact position of the contact member 10. A Z contact position is the Z-direction position, that is, the Z-direction contact position of the orifice array. Referring to FIGS. 10A to 10C, reference numerals 15A and 16A denote areas of the contact surface on the wiping member that wipes the printheads 31 and 32; and 30, an orifice array interval corresponding to an area where the printheads 31 and 32 are spaced apart from each other. Note that the remaining names in the drawings are the same as those described with reference to the drawings up to FIGS. 9A to 9B, and a description thereof will be omitted.

First, at the timing shown in FIG. 10A, the wiping operation of the first orifice array group is performed. In this embodiment, the first orifice array group includes the orifice arrays 21 to 26. As shown in FIG. 10A, the contact member 10 is pushed up from a retracted position (not shown) to the Z contact position before the first wiping target orifice array (orifice array 26 in FIG. 10A) moves to the X contact position. After that, as the printheads 31 and 32 move, the first wiping target orifice array moves to the X contact position and contacts the area 16A on the wiping member, thereby executing a wiping operation. This wiping operation is executed using the area 16A on the wiping member from the orifice array 26 in the order of the orifice arrays 25, 24, 23, 22, and 21 as the carriage moves.

FIG. 10B shows a state in which the wiping operation of the printhead 32 ends, an the orifice array interval 30 is located at a position facing the contact member 10, that is, the X contact position where the wiping member 9 contacts neither of the printheads as the carriage moves. At this time, a winding unit 9A winds the wiping member 9 by an amount corresponding to the area used to wipe the orifice arrays 21 to 26, that is, the area 16A in a direction in which the contact surface of the wiping member 9 travels along the moving direction of the printheads 31 and 32 (clockwise in FIGS. 10A to 10C). When wiping the next wiping target orifices, the new contact surface on the wiping member, that is, the area 15A is used.

At the timing shown in FIG. 10C, the wiping operation of the second orifice array group is performed. As shown in FIG. 10C, the area 15A on the wiping member contacts the orifice array 16 as the printheads move, thereby executing the wiping operation. This wiping operation is executed using the area 15A on the wiping member from the orifice array 16 in the order of the orifice arrays 15, 14, 13, 12, and 11. With this operation, the wiping operation of the orifice arrays of the printhead 31 is completed.

After completion of the wiping operation of the second orifice array group, the winding unit 9A winds the wiping member 9 by an amount corresponding to the area used to wipe the orifice arrays 11 to 16, that is, the area 15A. Note that the winding operation is performed with the contact member 10 remaining pushed up but may be performed after the contact member 10 is lowered.

When the above-described operation is performed, the contact surface of the wiping member used the wiping operation can be changed between the inks discharged from the orifice arrays 21 to 26 and those discharged from the orifice arrays 11 to 16. For this reason, for example, if one of the inks discharged from the orifice arrays 21 to 26 and one of the inks discharged from the orifice arrays 11 to 16 are reactive with each other, the wiping operation can prevent the inks from mixing and reacting on the orifice surfaces of the printheads.

In a case where the orifice array interval 30 does not exist between the two printheads, the contact member needs to be lowered to the position where the orifice surface of the printhead does not contact the wiping member to feed the new contact surface of the wiping member. It is necessary to then perform the operation of feeding the new contact surface, and after that, push up the contact member again. Hence, a long time is required to complete the series of wiping operations. In this embodiment, however, the orifice array interval 30 exists between the orifice arrays to be selectively wiped. It is therefore possible to feed the new contact surface in a state in which the wiping member 9 exists at the contact position and suppress the wiping operation time.

Fourth Embodiment

An example will be described here in which a wiping unit including two contact members (first contact member and second contact member) 10A and 10B that are independently movable between the Z retracted position and the Z contact position is used, unlike the first to third embodiments.

Figures 11A, 11B, 11C:
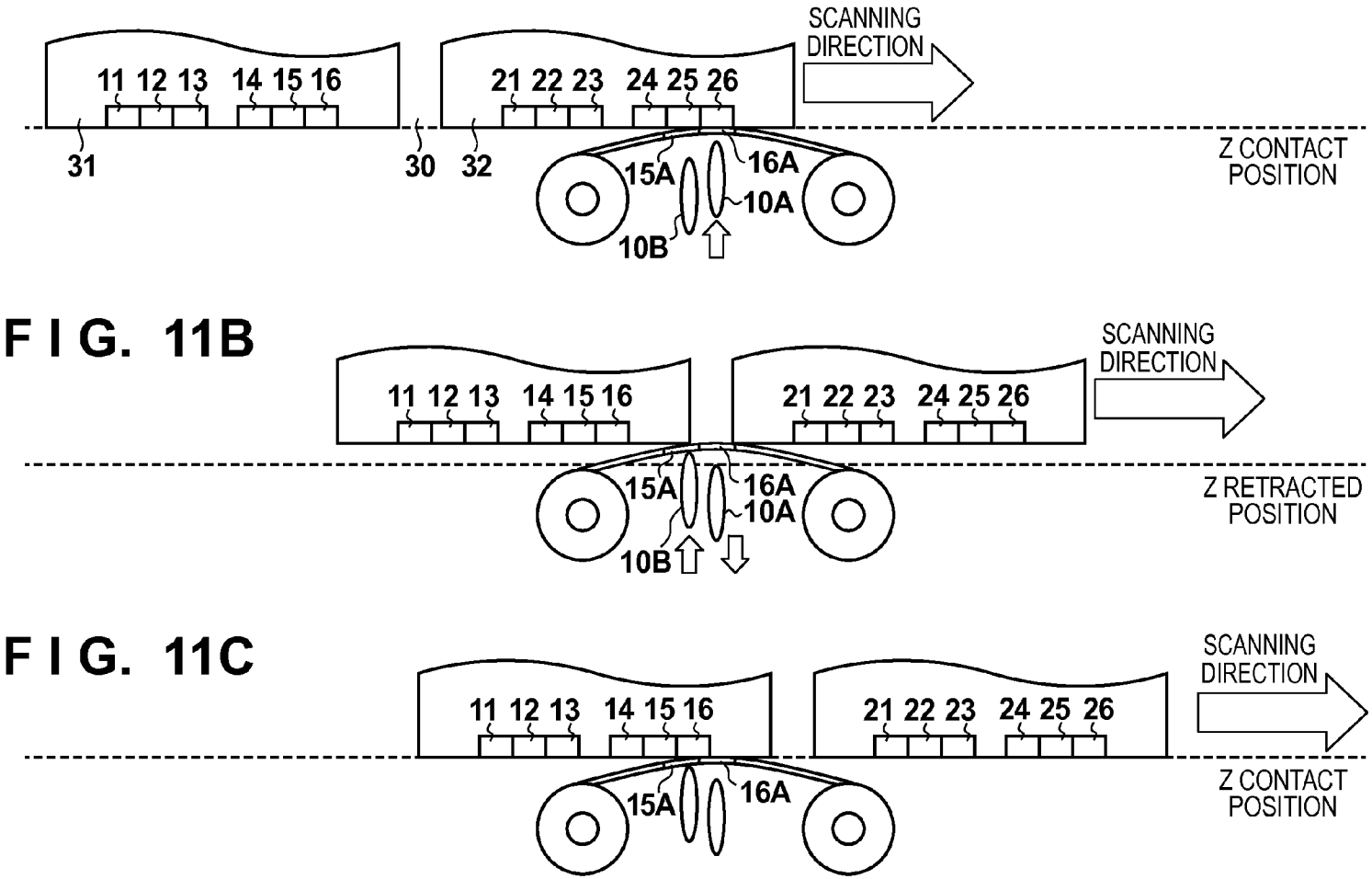
FIGS. 11A, 11B, and 11C are views showing a state in which a wiping operation is performed using two contact members.

FIGS. 11A to 11C are views showing a state in which a wiping operation is performed using the two contact members. As shown in FIGS. 11A to 11C, the contact members 10A and 10B are juxtaposed in the winding direction of the wiping member. As shown in FIG. 11B, the Z retracted position is the Z-direction position where the contact members 10A and 10B do not contact the orifice arrays of printheads 31 and 32 regardless of the positions of the printheads. The remaining matters are the same as in FIGS. 10A to 10C, and a description thereof will be omitted.

First, at the timing shown in FIG. 11A, the wiping operation of the first orifice array group is performed. In this embodiment, the first orifice array group includes orifice arrays 21 to 26. As shown in FIG. 11A, the contact member 10A is pushed up to the Z contact position before the first wiping target orifice array (orifice array 26 in FIG. 11A) moves to the X contact position. At this time, the other contact member 10B is retracted to the Z retracted position. As the printheads 31 and 32 move, the first wiping target orifice array moves to the X contact position and contacts an area 16A on the wiping member, thereby executing a wiping operation. This wiping operation is executed using the area 16A on the wiping member from the orifice array 26 in the order of the orifice arrays 25, 24, 23, 22, and 21.

In FIG. 11B, the area of a wiping member 9 to contact the orifice array of the printhead is switched. As shown in FIG. 11B, after completion of wiping of the orifice arrays 21 to 26 included in the first wiping target orifice array group, an orifice array interval 30 is located at a position facing the contact members 10A and 10B, that is, the X contact position where the wiping member 9 contacts neither of the printheads as the carriage moves. At this time, the contact member 10A is retracted from the Z contact position to the Z retracted position, and the contact member 10B is pushed up from the Z retracted position to the Z contact position. With this operation, the area 16A on the wiping member used to wipe the orifice arrays 21 to 26 lowers to a position where the area does not contact the orifices. An area 15A pushed up by the contact member 10B is used as the contact surface to the orifice array when wiping the next wiping target orifices.

At the timing shown in FIG. 11C, the wiping operation of the second orifice array group is performed. As shown in FIG. 11C, the area 15A on the wiping member contacts the orifice array 16 as the printheads move, thereby executing the wiping operation. This wiping operation is executed using the area 15A on the wiping member from the orifice array 16 in the order of orifice arrays 15, 14, 13, 12, and 11. With this operation, the wiping operation of the orifice arrays of the printhead 31 is completed.

After completion of the wiping operation of the second orifice array group, a winding unit 9A winds the wiping member 9 by an amount corresponding to the area used to wipe the orifice arrays 11 to 16 and the orifice arrays 21 to 26, that is, the areas 16A and 15A.

As described above, in this embodiment, after the first wiping target orifice array group is wiped, the contact member that contacts the wiping member is switched without winding the wiping member, as compared to the third embodiment. This makes it possible to feed the new contact surface of the wiping member.

Note that although a case where the orifice array interval 30 is formed between the printheads 31 and 32 has been described in the third and fourth embodiments, the present invention is not limited to this. For example, concave portions may be provided between the orifice arrays of one printhead to provide orifice array intervals in the printhead.

In the third and fourth embodiments as well, an example has been described in which the orifice arrays are selectively wiped in the direction in which the printhead 3 moves toward the X contact position. However, the wiping operation may be done when the printhead moves away from the X contact position.

The present invention is applicable to any apparatus using a printing medium made of paper, cloth, leather, nonwoven fabric, OHP sheet, or metal. Specific examples of the applicable apparatus are office machines such as a printer, copying machine, and facsimile apparatus using an inkjet printing method and industrial production machines.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-018957, filed Feb. 1, 2013, which is hereby incorporated by reference herein in its entirety.

What is claimed is:

1. A printing apparatus comprising:

a printhead having an orifice surface on which a first group of orifices are arranged in a first area and a second group of orifices are arranged in a second area;

a carriage, on which said printhead is mounted, configured to move in a first direction, so as to serially print on a printing medium from said printhead, wherein the first area is positioned upstream of the second area with respect to the first direction;

a sheet-like wiper for wiping the orifice surface of said printhead;

a changing unit configured to move an area, of said sheet-like wiper, which faces the orifice surface, in the first direction so that a contact area, of said sheet-like wiper, which contacts to the orifice surface, is changed; and a control unit configured to control said carriage and said changing unit such that said sheet-like wiper wipes the first area by moving said carriage in the first direction, said changing unit changes the contact area of said sheet-like wiper by moving said sheet-like wiper in the first direction after wiping the first area, and then said sheet-like wiper wipes the second area by moving said carriage in the first direction.

2. The apparatus according to claim 1, further comprising a winder for winding said sheet-like wiper, wherein said sheet-like wiper and said winder constitute a wiping unit, and said wiping unit is provided at one end of reciprocating motion of said carriage.

3. The apparatus according to claim 1, further comprising a contact member which makes the sheet-like wiper move between a contact position where the sheet-like wiper contacts the orifice surface and a retracted position where the sheet-like wiper retracts from the orifice surface, wherein said control unit controls said contact member to move the sheet-like wiper from the contact position to the retracted position after the first area is wiped by a single wiping operation, controls said changing unit to change the contact area of said sheet-like wiper, controls said contact member to move the sheet-like wiper from the retracted position to the contact position, and controls said carriage such that the second area is wiped by a next single wiping operation.

4. The apparatus according to claim 3, wherein said contact member includes:

a first contact member configured to move part of said sheet-like wiper so that an area of the part of said sheet-like wiper contacts the orifice surface or retracts from the orifice surface; and a second contact member configured to move the part of said sheet-like wiper so that another area of the part of said sheet-like wiper different from the area to be moved by said first contact member contacts the orifice surface or retracts from the orifice surface.

5. The apparatus according to claim 4, wherein in a case where the first and second areas of each of said plurality of printheads are sequentially wiped as said carriage moves, when the area of said part of the sheet-like wiper is made to contact to the orifice surface of one of said plurality of printheads using said first contact member, and a contact position of said sheet-like wiper with respect to the orifice surface has reached the area where said printheads are spaced apart from each other after completion of wiping of the first and second areas is included in the orifice surface in contact, said control unit controls said first contact member to retract the part of said sheet-like wiper used for the wiping from the orifice surface and simultaneously controls said second contact member so that an area of the part of said sheet-like wiper different from the area made to contact by said first contact member contacts the orifice surface, and then controls said carriage such that the first and second areas of a next one of said plurality of printheads are wiped by a next wiping operation.

6. The apparatus according to claim 1, wherein the first and second groups of orifices discharge different inks, respectively.

7. The apparatus according to claim 1, wherein a plurality of printheads are mounted on said carriage while being juxtaposed in the first direction, an area where said printheads are spaced apart from each other is provided between said plurality of printheads, and the first and second groups of orifices of said plurality of printheads discharge inks reactive with each other.

8. The apparatus according to claim 7, wherein in a case where the first and second areas of each of said plurality of printheads are sequentially wiped as said carriage moves, said control unit controls said changing unit to change the contact area of said sheet-like wiper when a contact position of said sheet-like wiper with respect to the orifice surface has reached the area where said printheads are spaced apart after completion of wiping of the first and second areas of one of said plurality of printheads, and controls said carriage such that the first and second areas of a next one of said plurality of printheads are wiped by a next wiping operation.

9. A cleaning method in a printing apparatus including a printhead having an orifice surface on which a first group of orifices are arranged in a first area and a second group of orifices are arranged in a second area, and a carriage, on which the printhead is mounted, configured to move in a first direction, so as to serially print on a printing medium from the printhead, wherein the first area is positioned upstream of the second area with respect to the first direction, the method comprising:

wiping the first area with a sheet-like wiper by moving the carriage in the first direction;

changing a contact area of the sheet-like wiper, which contacts the orifice surface, by moving the sheet-like wiper in the first direction after wiping the first area; and wiping the second area with the sheet-like wiper by moving the carriage in the first direction after changing the contact area.

10. The method according to claim 9, further comprising:

retracting, after the first area is wiped by a single wiping operation, part of the sheet-like wiper from the orifice surface;

winding the sheet-like wiper;

moving part of the wiping member to contact to the orifice surface again; and wiping the second area by a next single wiping operation.

11. The method according to claim 10, wherein the first and second groups of orifices discharge different inks, respectively.

12. The method according to claim 9, wherein a plurality of printheads are mounted on the carriage while being juxtaposed in the first direction, an area where the printheads are spaced apart from each other is provided between the plurality of printheads, and the first and second groups of orifices of the plurality of printheads discharge inks reactive with each other.

13. The method according to claim 12, further comprising, in a case where the first and second areas of each of the plurality of printheads are sequentially wiped as the carriage moves:

winding the sheet-like wiper when a contact position of the sheet-like wiper with respect to the orifice surface has reached the area where the printheads are spaced apart from each other after completion of wiping of the first and second areas of one of the plurality of printheads; and wiping the first and second areas of a next one of the plurality of printheads by a next wiping operation.

14. The method according to claim 12, further comprising, in a case where the printing apparatus includes (i) a first contact member configured to move part of the sheet-like wiper so that an area of the part of the sheet-like wiper contacts the orifice surface or retracts from the orifice surface and (ii) a second contact member configured to move the part of the sheet-like wiper so that an area of the part of the sheet-like wiper different from the area to be moved by the first contact member contacts the orifice surface or retracts from the orifice surface and in a case where the first and second areas of each of the plurality of printheads are sequentially wiped as the carriage moves;

moving the first contact member to retract the part of the sheet-like wiper used for the wiping from the orifice surface and simultaneously moving the second contact member so that the area of the part of the sheet-like wiper different from the area made to contact by the first contact member contacts the orifice surface when the area of the part of the sheet-like wiper is made to contact the orifice surface of one of the plurality of printheads using the first contact member and a contact position of the sheet-like wiper with respect to the orifice surface has reached the area where the printheads are spaced apart from each other after completion of wiping of the first and second areas is included in the orifice surface in contact, and wiping the orifices of the first and second areas of a next one of the plurality of printheads by a next wiping operation.

* * * * *